United States Patent [19]

Bratko et al.

[11] 4,189,297

[45] Feb. 19, 1980

[54] MATRIX MOUNTING MEANS FOR GAS BURNERS

[75] Inventors: Rudolph S. Bratko, Hinckley; Werner Zwipf, Parma, both of Ohio

[73] Assignee: Slyman Manufacturing Corporation, Parma, Ohio

[21] Appl. No.: 845,643

[22] Filed: Oct. 26, 1977

[51] Int. Cl.[2] ..... F23D 13/12

[52] U.S. Cl. ..... 431/328

[58] Field of Search ..... 431/328, 329

[56] References Cited

U.S. PATENT DOCUMENTS

| | | | |
|---|---|---|---|
| 3,008,513 | 11/1961 | Holden | 431/328 |
| 4,035,132 | 7/1977 | Smith | 431/7 |

*Primary Examiner*—Carroll B. Dority, Jr.

*Attorney, Agent, or Firm*—Pearne, Gordon, Sessions

[57] ABSTRACT

There is disclosed infra-red burner construction which includes the use of a burner face comprising a mat or matrix of fibrous felt refractory composition, required to be positioned at the open side of a plenum through which a combustible medium is supplied to the face, the means to maintain the matrix in position being insulated from the surface at which infra-red generation takes place, and the plenum being positioned within a second plenum, in a manner to provide passageways for a non-combustible medium to be directed outwardly beyond the face of the matrix at the periphery thereof, to prevent undesired heating of either plenum or ignition and burning of combustible mixture beyond the edges of the matrix.

8 Claims, 3 Drawing Figures

MATRIX MOUNTING MEANS FOR GAS BURNERS

BACKGROUND OF THE INVENTION

In the prior art relating to infra-red generation and burners designed therefor, particularly in those types of burners which involve the use of a fibrous refractory felt burner face which is permeable to a combustible mixture, a number of problems have arisen which are sufficiently important to justify modification of the burners, and in this respect the patents of one of the inventors hereof, namely the Bratko U.S. Pat. Nos. 3,824,064 and 3,785,763 have not contemplated the problem herein, which is that of confining the heat from infra-red generation to the surface and prevent its spreading outside the edges of the burners, with the consequent possibility that ignition of escaping gases could take place and heat the bodies of the burners in such a manner to adversely affect the operation thereof.

The prior patent of Smith, U.S. Pat. No. 4,035,132, is directed to the general problem herein under consideration, namely that of confining the heat and infra-red generation to the face of the burner and preventing undesired heating of certain hold-down angles but is not satisfactory from the standpoint that a line of definition is created around the perimeter of the burner face, which decreases the area of infra-red generation, and is in some cases not clearly enough defined so as to anticipate the problems which might otherwise be resolved by the construction. It is desired that complete generation over the entire face of the burner be effected so that the area of the burner may be used completely and advantageously for application to the object or material toward which the radiation is directed. In the said Smith patent, the periphery or perimeter of the burner face, is arranged to have a non-combustible mixture forced therethrough and around a hold-down or mounting angle and to cool the same there is wide variation in extent of reduction of the face generation. Consequently arrangement of burners of this nature side by side, may often cause problems in the infra-red generation so that a continuous area of the elements or members to which the radiation is directed is not covered thereby.

Other problems involved in the construction of burners of the Smith type are overcome and anticipated by the construction herein to be described and set forth in the claims appended to this disclosure.

It is a principle object of this invention therefore to provide an infra-red burner, in which the face thereof is entirely devoted to the generation of infra-red radiation, and the edges of the burner are so aranged that heat spill-over will not adversely affect the body of the burner, the construction being such that clear lines of definition of radiation are developed.

A further object of the invention is to provide construction of a burner in which a provision is made for the delivery of air in a sort of curtain around the periphery of the burner in such a manner to confine the heat spill-over, or at most minimum spill-over will not affect the burner body itself because of the use of non-combustible medium passing outwardly along said periphery.

A further object of the invention is to provide an infra-red burner of the class described, in which plenum construction is furnished to facilitate the direction of a non-combustible mixture around the periphery of a burner face, eliminate hold-down means on the surface of the matrix and enable arrangement of a series of burners closely positioned adjacent one another with no adverse affects from wide spacing of edges and thus gaps in infra-red generation.

Other and further objects of the invention will be understood from a consideration of the specification appended hereto and disclosed in the drawings which include the following figures.

DESCRIPTION OF THE INVENTION

Figure 1:
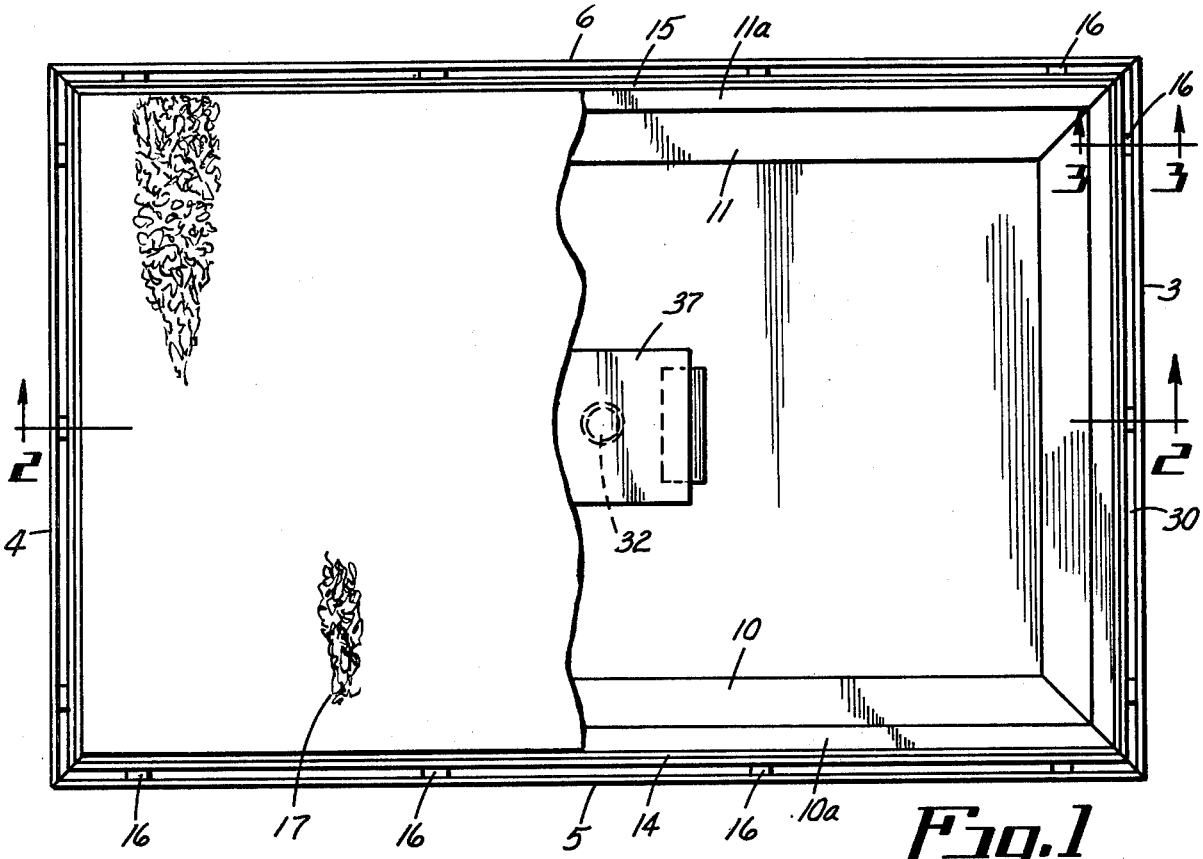
FIG. 1 is a plan view of a burner showing the arrangement of the face and of the plenum with the passageways provided for delivery of a non-combustible mixture at the periphery of the burner.
Figure 2:
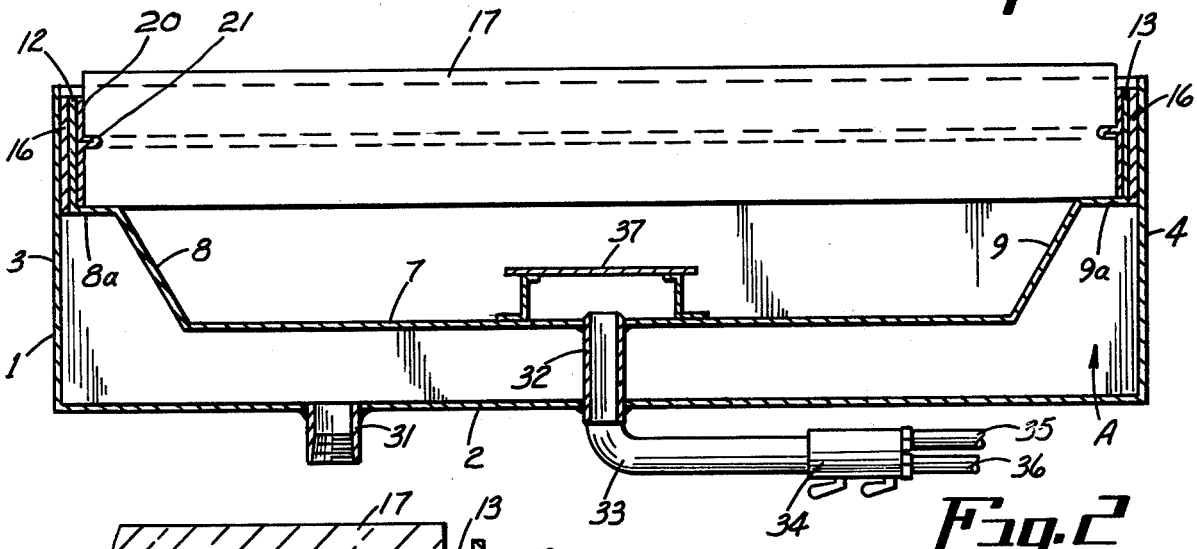
FIG. 2 is a vertical sectional view about on the line 2—2 of FIG. 1 looking in the direction of the arrows showing details of construction of the burner.

Referring now to the drawing, the burner hereof is shown as comprising the housing as generally rectilinear form designated 1, being constructed with a flat bottom generally designated 2, the upstanding end walls 3 and 4, with the side walls 5 and 6, the walls being at substantially right angles to the bottom 2 and therefore providing an upwardly open plenum.

Arranged within the first plenum just described, is a second plenum having the flat bottom generally designated 7, with the wall parts at the ends designated 8 and 9 being outwardly diverging and having intermediate their extremities the shoulders **8*a* and 9*a* respectively, corresponding sidewalls 10 and 11 having similar shoulders 10*a* and 11*a* extending parallel to the bottom 7**.

At the extremities of the shoulders **8*a*, 9*a*, 10*a* and 11*a*, upwardly extending elements or wall portions 12, 13, 14 and 15 are provided, terminating about at the same height as the vertical walls 3 to 6** inclusive to the outer plenum, and being spaced slightly therefrom so as to provide a passageways between such walls and such wall elements.

The passageways are determined by spacers such as 16 which are positioned suitably around the perimeter so as to maintain the spacing desired and the small passageways provided thereby.

As a matter of fact the passageways are desirably about 0.023 of an inch in width.

Shoulders **8*a* to 11*a* inclusive, are provided to support a burner face, which comprises a matrix 17** which is desirably of a fibrous refractory, relatively dense, structurally self-supporting, felt material of what may be termed mat form and of substantial thickness.

Figure 3:
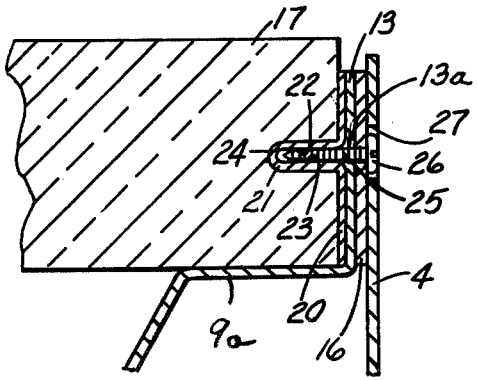
FIG. 3 is an enlarged fragmentary view taken about on the line 3—3 of FIG. 1 looking in the direction of the arrows.

This matrix 17, is provided with a peripheral band generally designated 20, which is essentially equal in width to the thickness of the matrix 17 and formed as more particularly disclosed in detail in FIG. 3, with a tongue portion 21 about midway between its upper and lower edges as viewed in said figure, the tongue having the interior spaced surfaces 22 and 23 for purposes which will appear as this description proceeds.

This band 20, will be formed on all sides similarly, and is intended to be seated in grooves such as 24 formed in each edge of matrix 17 and thus a plurality of grooves is provided, the band 20 being desirably a continuous member and thus closely enclosing the matrix 17. Further the surface of the periphery of the matrix 17 is initially painted or swabbed with a sodium silicate solution, prior to the installation of the band 20 therearound so that a sealing of the contact area provided thereby is effected.

When the matrix 17 is seatd in position on the shoulders 8*a* to 11*a* inclusive, the same are preliminarly coated with what is known as RTV silicone cement made by Dow Chemical Co. to seal the lower surface of the matrix 17 against said shoulders.

In order to position the plenums with respect to the other, that is the outer plenum 1 with respect to the inner plenum, suitable fastening means are provided about the perimeter of the burner, and as disclosed in FIG. 3 consist of the sheet metal screws such as 25, which are entered in openings such as 13*a* formed in the wall portions and in turn enter the space between the inner walls 22 and 23 of the tongues 21 for example so that the respective parts are thereby positioned as shown, the head 26 of each of the fasteners 25, being positioned in openings such as 27 formed in the end wall 4, as disclosed, a series of these openings being provided so that the head is essentially flush with the outer surface of such wall.

It will be understood that similar fasteners 25 may be spaced around the periphery, to be positioned in the side walls such as 5 and 6 as well as the opposite end wall 3 to thereby position all of the respective parts with respect to one another, and enable the removal of parts with a minimum amount of difficulty.

The spacers 16, determining as they do, the width of the passageways extending around the perimeter and specifically around the periphery of the matrix 17, are fastened in any suitable manner to the inner side of the walls such as 4, with openings if necessary extending therethrough to receive a fastener 25 if that is the location where the fastener should be positioned.

It is seen that the passageways provided by the spacers 16, hereafter designated 30, are in fact narrow passageways positioned around the periphery of the matrix and outside the band member 20, and wall portions such as 13, 14 and 15.

The provision of these passageways, is for the purpose of confining the infra-red generating area of the infra-red burner, and the radiation developed thereby preventing any heat likewise produced from spilling over onto the walls of the plenum. For that purpose there is supplied a non-combustible medium between the respective plenums, and in this instance to the area which will be defined as A.

In order to effect this introduction, a suitable supply nipple or coupling 31 is provided, fastened at the lower or bottom 2 so as to permit the connection of the same to a source of a non-combustible medium to be directed thereinto.

It will be apparent that by introducing a non-combustible medium through the coupling 31, the same will surround the inner plenum, and be forced upwardly and outwardly through the passages 30, and along the periphery of the matrix 17.

In order to provide a combustible mixture to the matrix 17 so as to pass therethrough, a connection such as 32 is provided, extending from a mixture supply pipe 33, and a mixture valve 34 from suitable sources of air and gas 35 and 36 for example. These are under suitable pressure so as to provide a combustible mixture to be introduced through the connection 32 into the inner plenum.

Above the connection 32 is a baffle or diffuser 37, which will prevent direct impingement of the combustible mixture to a localized area thereabove, and in fact the diffuser will distribute the mixture so as to pass through the matrix and upon ignition burn at or near the surface thereof.

The matrix 17 being a fibrous felt refractory material, produces the infra-red radiation desired, and carries out the function of the burner itself, being controlled as will be apparent by any suitable means to regulate the introduction of the air-gas mixture or combustible mixture and distribution to the matrix.

While the matrix is producing infra-red radiation, the non-combustible mixture is passing out through the passageways 30 extending around the periphery of the matrix, and confines the heat there developed so that any spillover is far enough away from the actual burner housing itself as not to be destructive thereof or to in fact possibly effect ignition of any gases at or near the surface or edges of the housing so as to be destructive thereof or in fact to be destructive of any surrounding parts which are desired to be maintained at relatively low temperature beyond a predetermined point.

The production of infra-red radiation from the surface of the matrix 17 will cover the surface entirely and not be limited as to the perimeter of the surface by any non-combustible mixture passing therethrough, the construction being such as to make possible the assembly and disassembly of the respective parts for whatever purpose.

We claim:

1. In infra-red burner construction of the class described, in combination, an upwardly open combustion plenum, means extending around said plenum to support a burner face comprising a combustible medium permeable matrix, means extending around the periphery of said matrix to direct a non-combustible medium upwardly along said periphery entirely outside the same and beyond the upper surface of said matrix, means to supply said medium, instrumentalities to supply a combustible medium to and through said matrix to burn at or near the surface thereof to generate infra-red radiation, and means to regulate such supply, the means to direct the non-combustible mixture along the periphery being arranged to provide a narrow stream of such mixture close to said periphery and in such volume to prevent the combustible mixture from burning outside of said stream, a non-permeable band member extending around the periphery of the matrix to compel the combustible medium to pass entirely through the matrix to the upper face thereof, the band member being connected to the matrix for positioning the matrix at the opening of the combustion plenum, and means being provided to fasten the band member to the plenum.

2. In infra-red burner construction of the class described, in combination, a housing having walls forming an upwardly open first non-combustion plenum, a second upwardly open combustion plenum positioned within the first plenum, said second plenum having means to support and position a burner face comprising a combustible medium permeable matrix in position covering the opening in the second plenum, the respective plenums being arranged with the means to support the matrix with the periphery of the matrix spaced from the walls of the first plenum, to provide passageways around said periphery, means to supply a combustible medium to the second plenum and cause the same to pass through the matrix to thereby burn adjacent the upper surface thereof to generate infra-red radiation, and means to supply a non-combustible medium to the first plenum for circulating through the passageways aforesaid, the matrix being maintained in position at the open area of the second plenum by retaining instrumentalities at the periphery, said instrumentalities at the periphery including fastener parts extending from the first plenum engaging said instrumentalities, said matrix being maintained in position at the opening of the second plenum by fasterner receiving portions extending inwardly at the periphery, the retaining instrumentalities including fasterner parts extending through the walls of the first plenum and engaging said portions to position the matrix with respect to the second plenum, the second plenum being positioned within the first, and the spacing forming the passageways aforesaid.

3. The combination as claimed in claim 2, wherein the retaining instrumentalities comprise grooves extending inwardly in the peripheral edges of the matrix, and a band member having tongue sections extending into the grooves, positioned in contact with and extending substantially over said edges.

4. The combination as claimed in claim 2, wherein the matrix comprises a mat of fibrous, refractory, relatively dense, structurally self-supporting, felt material, and the retaining instrumentalities include inwardly extending grooves.

5. The combination as claimed in claim 2, wherein the matrix comprises a mat of fibrous, refractory, relatively dense, structurally self-supporting, felt material, and the retaining instrumentalities include inwardly extending grooves, said instrumentalities further including members having tongue sections with which the fastener parts engage.

6. In infra-red burner construction of the class described, in combination, a housing having walls forming an upwardly open first non-combustion plenum, a second upwardly open combustion plenum positioned within the first plenum, said second plenum having means to support and position a burner face comprising a combustible medium permeable matrix in position covering the opening in the second plenum, the respective plenums being arranged with the means to support the matrix with the periphery of the matrix spaced from the walls of the first plenum, to provide passageways around said periphery, means to supply a combustible medium to the second plenum and cause the same to pass through the matrix to thereby burn adjacent the upper surface thereof to generate infra-red radiation, and means to supply a non-combustible medium to the first plenum for circulating through the passageways aforesaid, the means to support the matrix in position comprising a band member closely conforming to the periphery of the matrix, means extending from the member into the matrix to fix the member with respect thereto, the second plenum having a shoulder to engage the lower surface of the matrix at the periphery thereof and upstanding walls closely conforming to the band member, said walls being spaced from corresponding and substantially co-extensive walls of the first plenum at the open end thereof to provide the passageways aforesaid, and means to fasten the band member and first and second plenums as stated to facilitate passing of the non-combustible medium through the passageways outwardly beyond the face of the matrix.

7. In infra-red burner construction of the class described, in combination, a housing having walls forming an upwardly open first non-combustion plenum, a second upwardly open combustion plenum positioned within the first plenum, said second plenum having means to support and position a burner face comprising a combustible medium permeable matrix in position covering the opening in the second plenum, the respective plenums being arranged with the means to support the matrix with the periphery of the matrix spaced from the walls of the first plenum, to provide passageways around said periphery, means to supply a combustible medium to the second plenum and cause the same to pass through the matrix to thereby burn adjacent the upper surface thereof to generate infra-red radiation, and means to supply a non-combustible medium to the first plenum for circulating through the passageways aforesaid, the means to support the matrix in position comprising a band member closely conforming to the periphery of the matrix, means extending from the member into the matrix to fix the member with respect thereto, the second plenum having a shoulder to engage the lower surface of the matrix at the periphery thereof and upstanding walls closely conforming to the band member, said walls being spaced from corresponding and substantially co-extensive walls of the first plenum at the open end thereof, to provide the passageways aforesaid, and means to fasten the band member and first and second plenums as stated to facilitate passing of the non-combustible medium through the passageways outwardly beyond the face of the matrix, the means to support and position the matrix covering the opening including the band member, said member having tongue elements with provisions to receive fastening means therein, the matrix including grooves in which said elements are positioned.

8. The combination as claimed in claim 7, wherein the upstanding walls of the second plenum are substantially co-extensive with the band member, spacers are provided between said walls and those of the first plenum substantially co-extensive therewith, the fastening means comprise headed screws whose shanks extend through the co-extensive walls of the second plenum, and are received in the interior of the tongue elements of the band member, the heads being positioned in the co-extensive walls of the first plenum when the assembly is in conditions for use.

* * * * *